US008317571B2

(12) United States Patent
Gariglio

(10) Patent No.: US 8,317,571 B2
(45) Date of Patent: Nov. 27, 2012

(54) GRINDING ASSEMBLY FOR GLASS SLABS AND GRINDING HEAD FOR A RECTILINEAR GRINDING MACHINE EQUIPPED WITH SUCH ASSEMBLY

(75) Inventor: Davide Gariglio, Volvera (IT)

(73) Assignee: Forvet S.R.L., Volvera (IT)

( * ) Notice: Subject to any disclaimer, the term of this patent is extended or adjusted under 35 U.S.C. 154(b) by 463 days.

(21) Appl. No.: 12/676,865

(22) PCT Filed: Sep. 13, 2007

(86) PCT No.: PCT/IT2007/000631

§ 371 (c)(1),
(2), (4) Date: Mar. 5, 2010

(87) PCT Pub. No.: WO2009/034588

PCT Pub. Date: Mar. 19, 2009

(65) Prior Publication Data

US 2010/0304645 A1 Dec. 2, 2010

(51) Int. Cl.
*B24B 49/00* (2012.01)

(52) U.S. Cl. ..... 451/11; 451/262; 451/278

(58) Field of Classification Search ..... 451/44, 451/182, 184, 190, 11, 262, 278
See application file for complete search history.

(56) References Cited

U.S. PATENT DOCUMENTS

| | | | | |
|---|---|---|---|---|
| 4,228,617 | A * | 10/1980 | Bando | 451/5 |
| 4,375,738 | A * | 3/1983 | Bando | 451/4 |
| 5,816,897 | A * | 10/1998 | Raeder et al. | 451/44 |
| 5,975,992 | A * | 11/1999 | Raeder et al. | 451/44 |
| 6,325,704 | B1 * | 12/2001 | Brown et al. | 451/44 |
| 7,134,936 | B2 * | 11/2006 | Gariglio | 451/11 |
| 2003/0092359 | A1 * | 5/2003 | Pedrini | 451/5 |

FOREIGN PATENT DOCUMENTS

| | | |
|---|---|---|
| EP | 1468784 A | 10/2004 |
| EP | 1649975 A | 4/2006 |

OTHER PUBLICATIONS

Forvet S.R.L., International Search Report, PCT/IT2007/000631, issued Jul. 12, 2007, 2 pages.

* cited by examiner

*Primary Examiner* — Maurina Rachuba
(74) *Attorney, Agent, or Firm* — David A. Farah; Shelson Mak & Anderson PC

(57) ABSTRACT

A grinding assembly is described, for a grinding head for a grinding machine of glass slabs, comprising: a first (and possibly a second) grinding wheel adapted to tangentially work on the glass edge and whose rotation axis A is parallel to the glass edge to be ground; and a handling system for the grinding wheel for adjusting the removal of glass in an oscillating way or in parallel with the plane of the slab to be ground. A grinding head equipped with the above grinding assembly is further described.

8 Claims, 5 Drawing Sheets

GRINDING ASSEMBLY FOR GLASS SLABS AND GRINDING HEAD FOR A RECTILINEAR GRINDING MACHINE EQUIPPED WITH SUCH ASSEMBLY

CROSS-REFERENCE TO RELATED APPLICATION

The present Application is a national stage of International Patent Application No. PCT/IT2007/000361, titled "Grinding Assembly for Glass Slabs and Grinding Head for a Rectilinear Grinding Machine Equipped With Such Assembly," filed Sep. 13, 2007, the contents of which are incorporated in this disclosure by reference in their entirety.

BACKGROUND OF THE INVENTION

1. Field of the Invention

The present invention refers to a grinding assembly for glass slabs and to a grinding head for a rectilinear grinding machine equipped with such system.

2. Background Art

As known, following etching and shearing operations, half-finished glass slabs are obtained, whose perimeter edges are in many cases ground in a grinding plant till the desired final geometry is reached. The grinding plants being used comprise a conveyor adapted to advance the glass slabs along an horizontal path through one or more working stations, each one of which houses a plurality of grinding wheels arranged in fixed positions along the path itself in order to grind two mutually opposite sides of the perimeter edge when advancing each slab.

The products obtained through the above-described known grinding plants have a not always satisfactory quality index, since, when the glass slabs advance along their related path, positioning and squaring errors of the slabs with respect to the grinding wheels can occur, so that the ground edges outlines sometimes are not perfectly straight or not perfectly orthogonal, with a scarce geometric accuracy of the finished product.

In order to simply and inexpensively solve the above mentioned problem, the Applicant of the present Application has filed patent EP-A-1468784, related to a grinding head 1 (see right side of FIG. 1) that allows accurately working each glass slab 2 in a working station where the slab 2 itself is kept in a univocal fixed reference position when working its related edge. A plurality of grinding heads 1, like the one disclosed in the above patent, are adapted to simultaneously work on all sides the glass slabs 2, through workings that are mutually different and are also operating at different speeds. The described grinding head 1, as shown in FIG. 1, substantially comprises, arranged in a row along the working direction of a glass slab 2: a grinding wheel 20 for the side grinding of the slab 2; a grinding wheel 22 for grinding the upper threads (or bevels) of the slab 2; a grinding wheel 24 for polishing the upper threads (or bevels) of the slab 2; a grinding wheel 26 for grinding the lower threads (or bevels) of the slab 2; a grinding wheel 28 for polishing the lower threads (or bevels) of the slab 2; and two grinding wheels 30, 32 for the side polishing of the slab 2. All grinding wheels 20 to 32 are supported and rotatingly driven by a respective spindle (not shown), and the grinding wheels 20 to 32 and their respective spindles are contained in and supported by a supporting structure 9.

It is also known that the removal capacity of a diamond grinding wheel in general essentially depends on its diameter. Therefore, when the head 1 must work very thick glass slabs 2, the grinding wheel 20 alone is not adequate for performing such working: it would therefore be necessary to provide for a grinding wheel 20 with a bigger diameter or an additional grinding wheel: both these solutions force to increase the width encumbrance of the head 1, and this is technically difficult, if not impossible, to carry out, since the heads 1 that can usually be found on a complete machine are at least four, in a mutual movement one with respect to the other along the sides of the glass slab 2 to be worked. In the end, the only possible solution with the current art technical knowledge is greatly increasing the grinding machine sides, which obviously is not preferable.

SUMMARY OF THE INVENTION

Therefore, object of the present invention is solving the above prior art problems, by providing a grinding head equipped with an innovative grinding assembly, that allows on one hand to use grinding wheels with a very big diameter (on the order of 200 mm, but that can be adjusted and increased at will) and on the other hand to only minimally increase the width encumbrance of the head, exploiting the thickness, rather than the width, of the grinding wheel of which the inventive assembly is composed. For this purpose, the grinding wheel of the inventive assembly works tangentially on the glass edge, and has it rotation axis parallel to the edge to be ground, differently from all other currently known grinding wheels, whose rotation axis is perpendicular or slanted with respect to the glass edge.

The above and other objects and advantages of the invention, as will appear from the following description, are obtained with a grinding head and machine as disclosed, respectively, in the independent claims. Preferred embodiments and non-trivial variations of the present invention are the subject matter of the dependent claims.

BRIEF DESCRIPTION OF THE DRAWINGS

The present invention will be better described by some preferred embodiment thereof, provided as a non-limiting example, with reference to the enclosed drawings, in which.

DETAILED DESCRIPTION OF PREFERRED EMBODIMENTS

With reference to the Figures, preferred embodiments of the grinding assembly and head of the present invention are shown and described. It will be immediately obvious that numerous variations and modifications (for example related to shape, sizes and parts with equivalent functionality) could be made to what is described, without departing from the scope of the invention, as appears from the enclosed claims.

Figure 1:
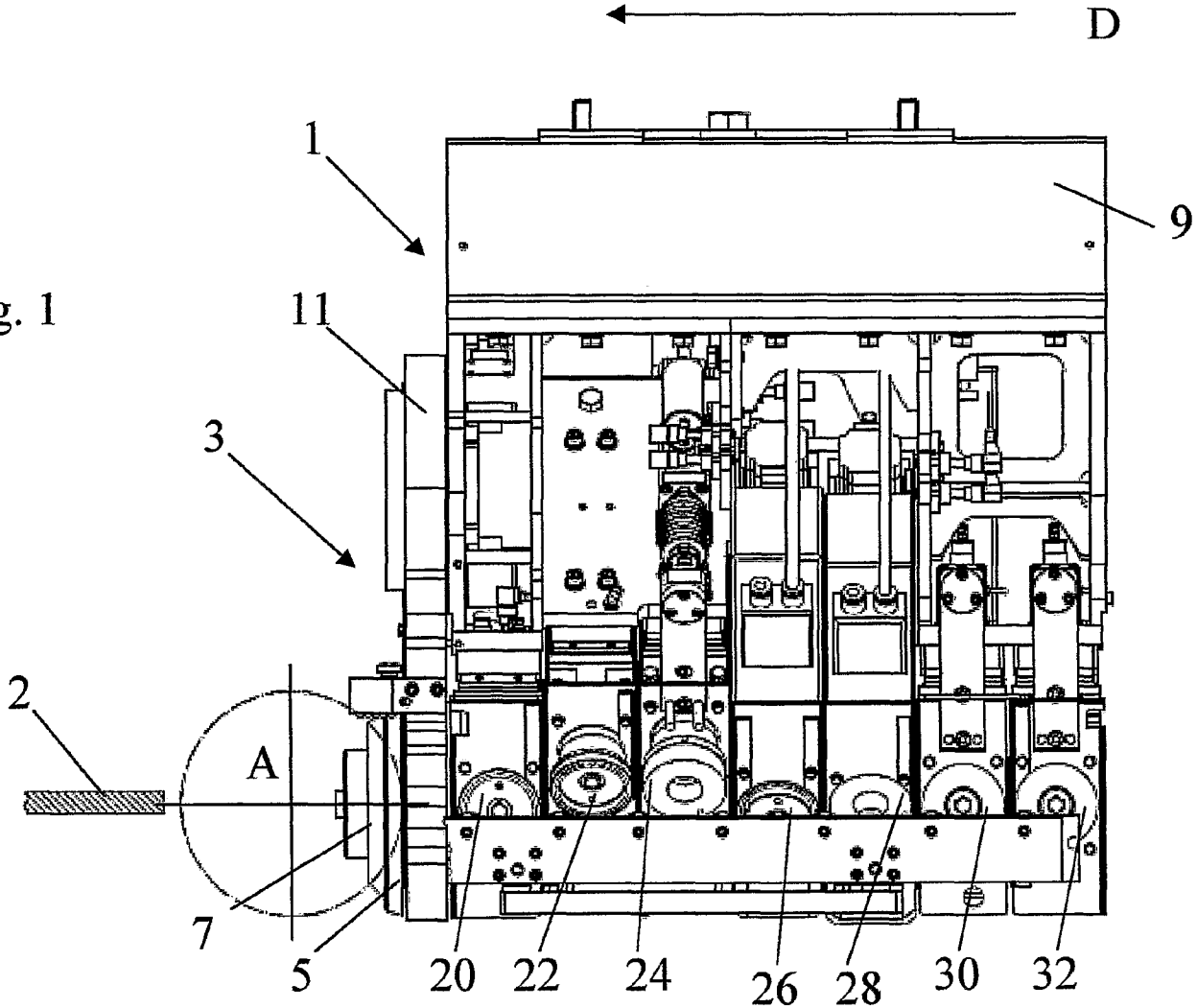
FIG. 1 is a side view of a preferred embodiment of the grinding head equipped with the grinding assembly according to the present invention.

With reference to FIG. 1, this has already been previously described, and provides for a grinding head 1, to which a preferred embodiment of the grinding assembly 3 of the present invention has been applied. As can be well seen from FIG. 1, the inventive assembly 3 is equipped with at least one diamond grinding wheel 5 that tangentially operates on the glass edge 2 and whose rotation axis A is parallel to the edge of the glass 2 to be ground. In this way, the assembly 3 allows saving a lot of space in its encumbrance, that is equal to the thickness of the grinding wheel 5, instead of its diameter, that can be thereby equal to 200 mm or more.

The removal of the grinding wheel 5 is adjusted by moving the grinding wheel 5 itself along the glass 2 direction (as known), through any handling system, in an oscillating way (direction B in FIG. 2) or in parallel (direction C in FIG. 2) to the plane of the slab 2 to be worked.

Figure 2:
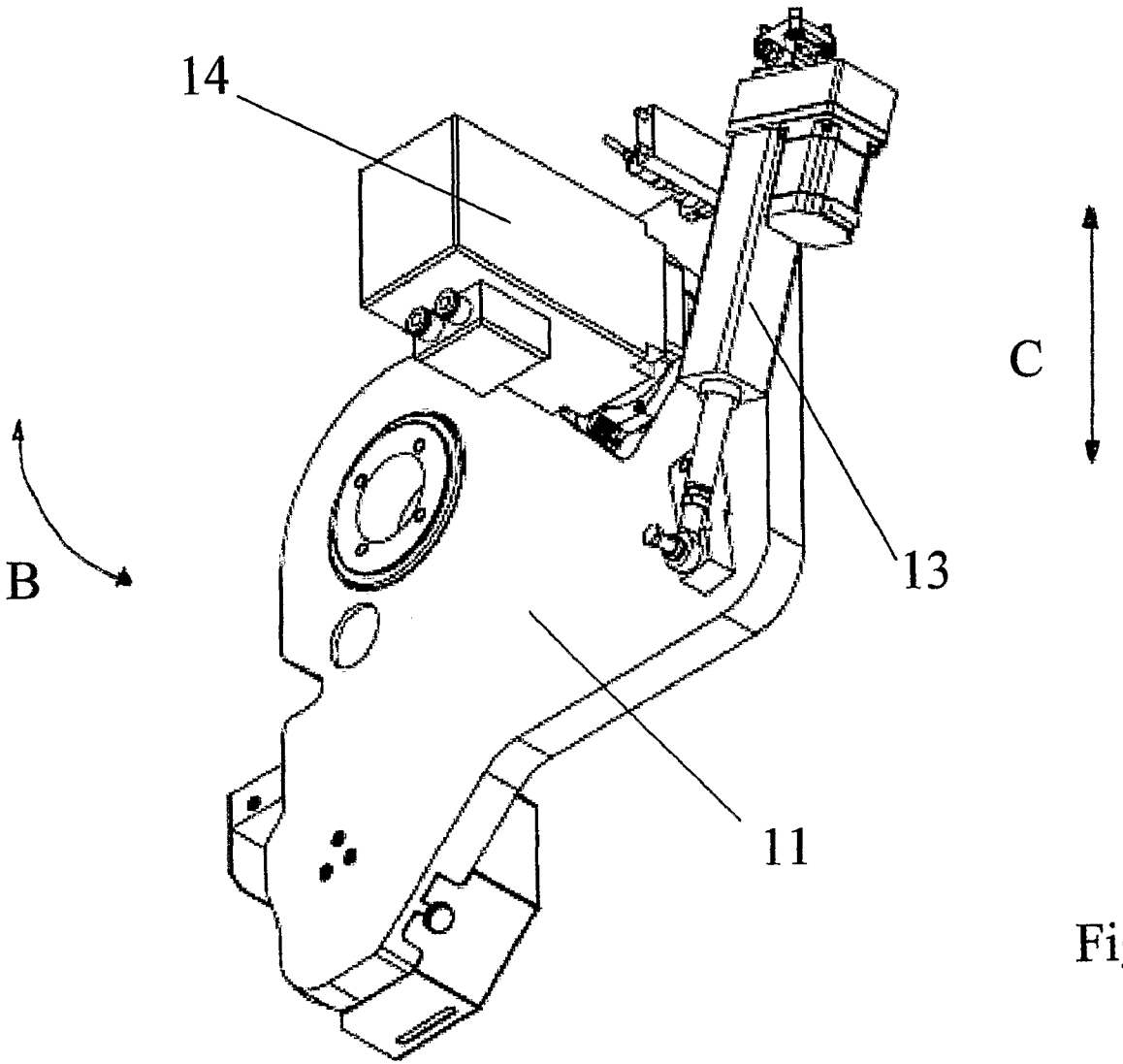
FIG. 2 is a perspective view of an embodiment of the handling system of the grinding assembly of the invention.
Figure 3:
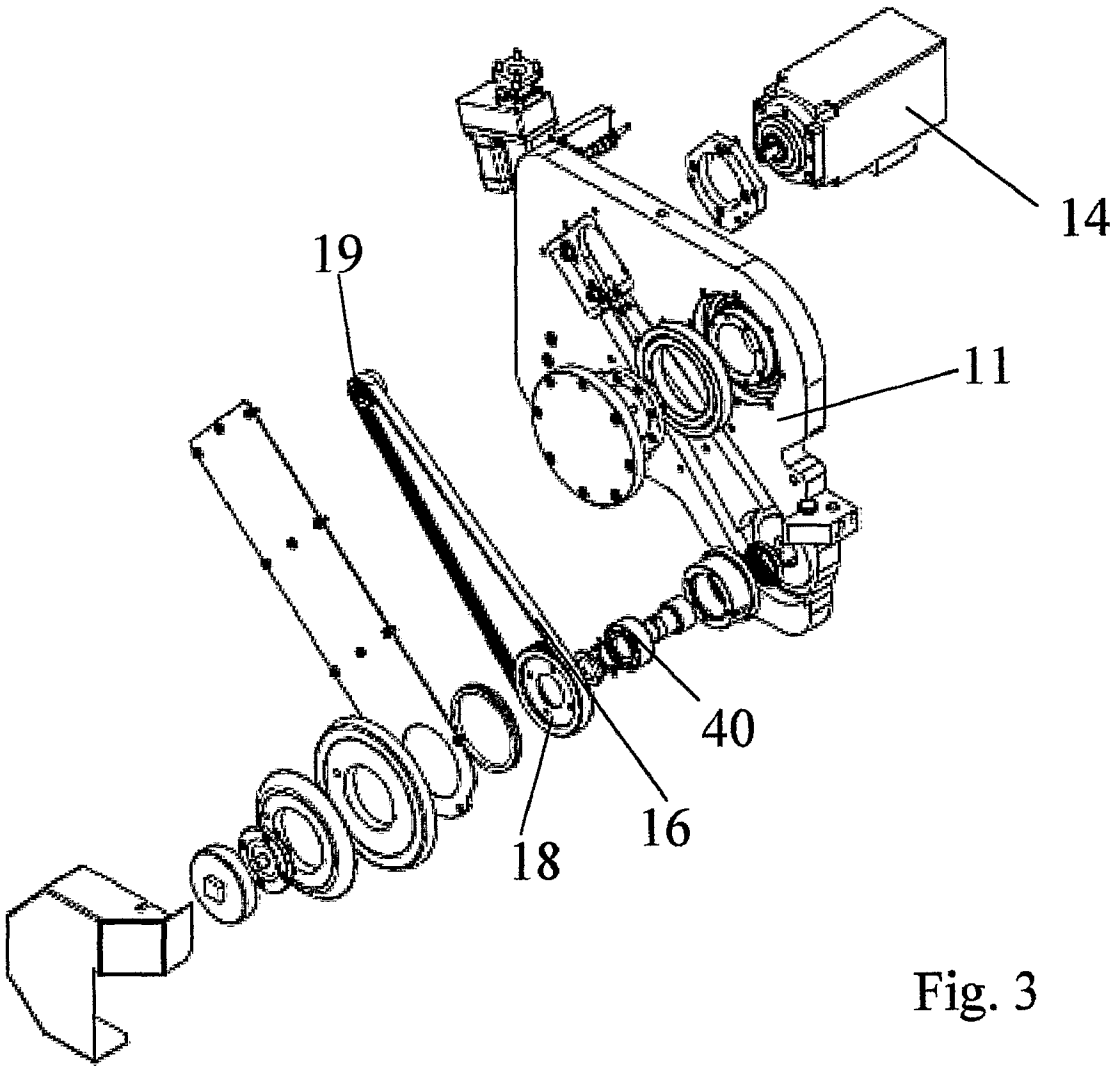
FIG. 3 is an exploded perspective view of the handling system of FIG. 2.

FIGS. 2 and 3 show a preferred, but absolutely not limiting, embodiment of the handling system of the grinding wheel 5, that can be suitably adapted to the head 1 of FIG. 1. Such system substantially comprises a cam-shaped supporting element 11 equipped with pushing means 13 (typically a ball re-circulation screw driven by a stepped motor or any other motor) adapted to push the supporting element 11 in operating directions B and C in FIG. 2. Moreover, the system comprises an actuating motor 14 shown in FIG. 3, adapted to transmit the rotary motion to the grinding wheel 5 through a system with belt 16 and pulleys 18, 19.

The particular arrangement of the above mentioned handling system allows housing the main bearings 40 of the grinding wheel 5 directly inside it (as can be seen in FIG. 3), greatly reducing the projection of the grinding wheel 5 with respect to a traditional grinding spindle.

It is obvious that the shown handling system is only one of the possible practical embodiments in which, from the mechanical point of view, movements of the head 5 can be performed along its two operating directions B and C: for example, driving guides could alternatively be provided, adapted for this purpose.

Still in general terms, the grinding assembly 3 of the present invention can be used by moving the grinding wheel 5 along the direction of the edge of the slab 2 to be ground, or by keeping the grinding assembly fixed and moving the slab 2, for example along the direction designated with D in FIG. 1.

As preferred, but not limiting, variation, the grinding wheel 5, if suitably shaped at 45°, as can be seen in the drawings, also allows performing a bevel on the edge of the glass 2 (operation that is more and more required by the market due to accident-preventing issues). Traditionally, this operation was performed by an additional grinding wheel, that operated as follower and performed an irregular (rounded) and scarcely accurate bevel.

Figure 4:
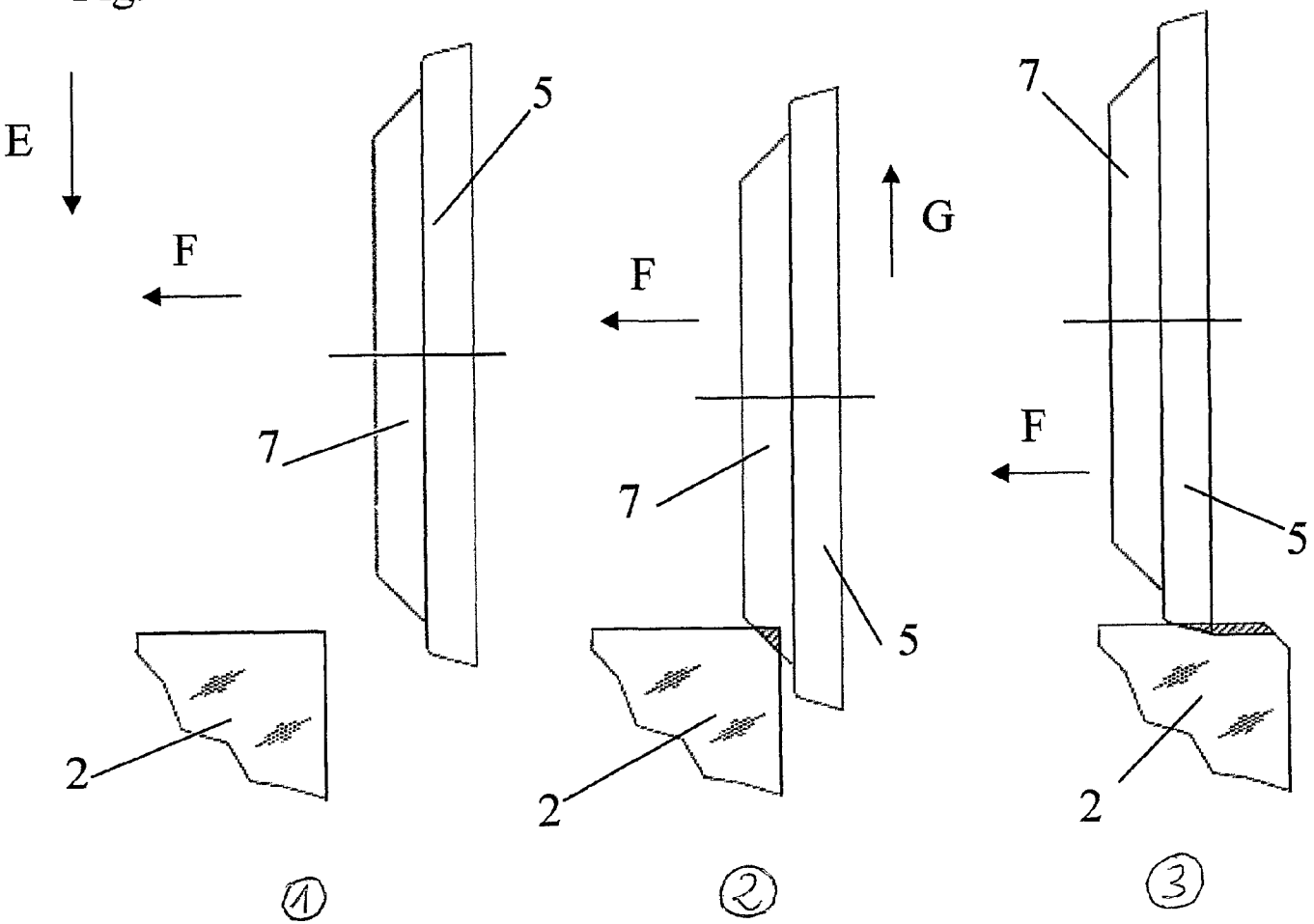
FIG. 4 is a schematic view that shows in detail the main operating steps of the grinding wheel of the grinding assembly of the invention.

With the inventive arrangement, instead, on the same hub housing the peripheral grinding wheel 5 of the invention, another grinding wheel 7 can be added, that works with the same principle, aimed for exclusively performing the grinding operation of the edge of the glass 2: such operation is shown in detail in FIG. 4, where, starting from the position designated with 1, the grinding wheel 7 is moved next to the angle to be worked with a movement along direction F. As can be seen in position 2, the grinding wheel 7 obtains a bevel with an operating advancement movement along direction E, while afterwards it is quickly moved away through a movement along direction G, until (position 3) the grinding wheel 5 is exactly in the correct position to engage the glass slab 2 by advancing along direction F, performing the bevel cutting at the desired thickness, together with the usual grinding operation of the slab 2.

Figure 5:
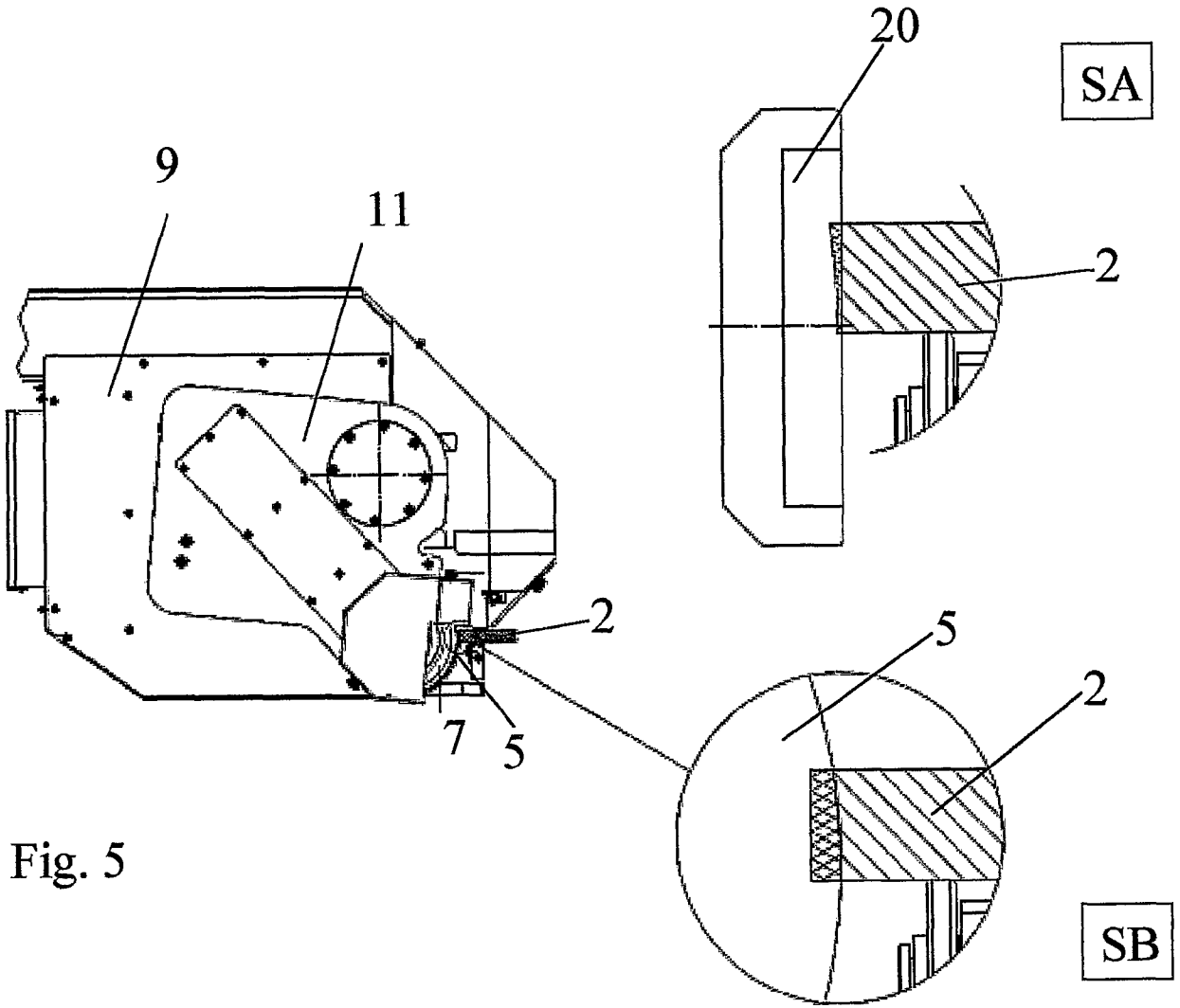
FIG. 5 is a side view of the grinding assembly of FIG. 2 detailing other two glass working steps.

The grinding wheel 5 of the invention performs, as can be better seen in FIG. 5, a removal of material with a slight curve (Step SB in FIG. 5); such slight curve is afterwards easily removed by the traditional grinding wheel 20 for side grinding (Step SA in FIG. 5), thereby efficiently completing the grinding work of the slab 2 with a minimum global encumbrance.

Both when it is equipped with the sole grinding wheel 5, and when it is equipped with both grinding wheels 5 and 7, it can therefore be easily seen that the grinding head 1 of the present invention allows providing a great capacity of removing material from a glass slab 2 of any size, with a really minimum additional encumbrance with respect to traditional heads.

The thereby shown grinding head 1 allows performing, on a fixed glass slab 2, a plurality of grinding and polishing operations, by driving the grinding wheels and their related spindles at mutually different speeds and by placing the grinding wheels next to different parts of the slab 2 on which it is necessary to perform the relevant working.

The invention claimed is:

1. A grinding assembly for a grinding head for a grinding machine for glass slabs, the grinding assembly comprising:

at least one first grinding wheel adapted to tangentially work on an edge of the glass slab and whose rotation axis is parallel to the edge of the glass slab to be ground;

a handling system for the first grinding wheel adapted to move the first grinding wheel to remove glass from the glass slab through oscillations or in parallel with the plane of the glass slab to be ground;

a cam-shaped supporting element equipped with pushing means adapted to push the supporting element along two operating directions of the supporting element; and an actuating motor adapted to transmit a rotary motion to the grinding wheel through a system with a belt and pulleys; and the handling system being thereby adapted to house main bearings of the grinding wheel directly inside the handling system.

2. The grinding assembly of claim 1, wherein the grinding assembly is further equipped with at least one second grinding wheel adapted to perform exclusively a grinding operation of an edge of the glass slab, the first grinding wheel being further adapted to cut the edge obtained by the second grinding wheel at a desired thickness.

3. The grinding assembly of claim 1, wherein the handling system further comprises driving guides.

4. A method for grinding a slab of glass, the glass slab comprising an edge, the method comprising:

a) providing the grinding assembly of claim 1; and b) moving the grinding wheel along a direction of the edge of the glass slab while keeping the glass slab fixed.

5. A method for grinding a slab of glass, the glass slab comprising an edge, the method comprising:

a) providing the grinding assembly of claim 1; and b) keeping the grinding assembly fixed and moving the glass slab.

6. The grinding assembly of claim 1, wherein the grinding wheel comprises a working surface shaped at 45° in order to perform a bevel on the edge of the glass slab.

7. A grinding head for a grinding machine for glass slabs comprising:

a supporting structure;

at least one first grinding wheel for laterally grinding the glass slabs, the first grinding wheel being supported and rotatingly driven by a first spindle, the first grinding wheel and the first spindle being contained in and supported by the supporting structure;

at least one second grinding wheel for grinding upper threads of the glass slabs, the second grinding wheel being supported and rotatingly driven by a second spindle, the second grinding wheel and the second spindle being contained in and supported by the supporting structure;

at least one third grinding wheel for polishing the upper threads of the glass slabs, the third grinding wheel being supported and rotatingly driven by a third spindle, the third grinding wheel and the third spindle being contained in and supported by the supporting structure;

at least one fourth grinding wheel for grinding lower threads of the glass slabs, the fourth grinding wheel being supported and rotatingly driven by a fourth spindle, the fourth grinding wheel and the fourth spindle being contained in and supported by the supporting structure;

at least one fifth grinding wheel for polishing lower threads of the glass slabs, the fifth grinding wheel being supported and rotatingly driven by a fifth spindle, the fifth grinding wheel and the fifth spindle being contained in and supported by the supporting structure; and at least one sixth grinding wheel for laterally polishing the glass slabs, the sixth grinding wheel being supported and rotatingly driven by a sixth spindle, the sixth grinding wheel and the sixth spindle being contained in and supported by the supporting structure;

the first grinding wheel and the sixth grinding wheel rotating, in a mutually independent way, around an axis that is perpendicular to an edge of the glass slabs, the second, third, fourth and fifth grinding wheels rotating, in a mutually independent way, around an axis that is slanted with respect to the edge of the glass slabs, the second, third, fourth and fifth grinding wheels being adapted to perform, when working, an axial movement along the glass slabs, the axial movements of the second, third, fourth and fifth grinding wheels being adapted to be activated independently one from the other, wherein the grinding head further comprises at least one grinding assembly.

8. The grinding head of claim 7, wherein the at least one sixth grinding wheels are two and are rotatingly driven by two respective sixth spindles.

* * * * *